United States Patent [19]

White

[11] 4,395,040

[45] Jul. 26, 1983

[54] ADJUSTABLE BASKETBALL GOAL

[76] Inventor: David White, 119 S. Main St., Fayette, Iowa 52142

[21] Appl. No.: 367,441

[22] Filed: Apr. 12, 1982

[51] Int. Cl.[3] ..... A63B 63/08

[52] U.S. Cl. ..... 273/1.5 R; 248/642; 248/284; 403/162

[58] Field of Search ..... 273/1.5 R; 248/281.1, 248/642, 641, 284; 403/162, 158

[56] References Cited

U.S. PATENT DOCUMENTS

| | | | |
|---|---|---|---|
| 2,782,034 | 2/1957 | Donoghue | 273/1.5 R |
| 2,964,341 | 12/1960 | Doyle et al. | 403/162 |
| 3,025,058 | 3/1962 | Brumfield | 273/1.5 R |
| 3,172,551 | 3/1965 | Wolfe | 248/281.1 X |
| 3,496,795 | 2/1970 | Dinnendahl | 403/158 X |
| 3,586,324 | 6/1971 | Bearson | 273/1.5 R |
| 3,614,099 | 10/1971 | Sarno | 273/1.5 R |
| 3,765,676 | 10/1973 | Bearson et al. | 273/1.5 R |
| 3,802,702 | 4/1974 | Pulley | 273/1.5 R |
| 3,880,392 | 4/1975 | Duganich | 273/1.5 R X |

*Primary Examiner*—Paul E. Shapiro

*Attorney, Agent, or Firm*—James C. Nemmers

[57] ABSTRACT

An adjustable basketball goal is mounted on a parallelogram supporting structure that permits the goal to be adjusted to different heights from 6 to 10 feet. The goal is raised and lowered by threaded members between portions of the supporting structure that provide sufficient mechanical advantage so that the adjustment can be easily made. The supporting structure also is designed to permit the goal to be secured directly to the supporting structure rather than just the backboard thereby minimizing the breaking off of the goals by a player hanging onto the rim. An adjustable length tension member extends between front and rear vertical supports of the supporting structure to take up slack in the structure as its pivotal connections wear with age.

2 Claims, 2 Drawing Figures

ADJUSTABLE BASKETBALL GOAL

BACKGROUND OF THE INVENTION

Basketball goals are purchased by the general public for home use and by schools and other organizations that provide athletic and recreational facilities. The regulation height of a basketball goal is too high for some of the smaller children, and thus, supporting structures have been developed which provide for the basketball goal to be lowered below the regulation height when the need arises. One such adjustable supporting structure is shown in Barson et al. U.S. Pat. No. 3,765,676, issued Oct. 16, 1973.

However, prior art supporting structures that use mechanical adjustments can be difficult to adjust because of the weight of the structure itself. Thus, some prior art structures, such as that shown in U.S. Pat. No. 3,765,676 utilize counterbalancing springs to make it easier to adjust the goal upwardly and downwardly. This of course adds to the cost and provides a certain amount of danger should the springs break.

In addition, prior art supporting structures are designed so as to receive the backboard-goal combination which is normally bolted or otherwise fastened to the supporting structure. These are adequate for most purposes, but with the current "dunk" craze, players more frequently hang on the rim and can tear the goal from the backboard. There is therefore a need for a method of securing the goal to the supporting structure so as to minimize tearing away of the goal if a player hangs on the rim. Also, there is little standardization of the mounting for the backboard-goal combinations, and adaptation of the supporting structure to receive the various mountings adds to the cost of the supporting structure.

SUMMARY OF THE INVENTION

The invention provides an improved adjustable basketball goal that can be used for players of almost any age. The improved supporting structure for the adjustable goal utilizes a mechanical screw arrangement that has improved mechanical advantage over prior art structures and which therefore allows the goal to be adjusted vertically with a minimum of effort and without the use of counterbalancing springs.

The invention provides a parallelogram arrangement in which the rear vertical support anchors an arm which is pivotally connected to the adjusting mechanism at one end with the other end of the adjusting mechanism pivotally connected to the lower horizontal arm of the parallelogram arrangement. By also providing a unique pivotal fastening means at the corners of the parallelogram structure, the joints of these corners can be completely tightened to provide a rigid structure while still permitting easy pivotal movement. The unique structure using a combination spacer-washer, also provides a larger bearing surface for the structural members to pivot on and facilitates assembly and standardization of components thus keeping the cost of the unit to a minimum.

In addition, the forward vertical supports provide a means of bolting the goal (rim) directly to the supporting frame through the backboard thus providing a stronger unit and minimizing the breaking of the goal from the board by players hanging on the rim. The design of the structure almost permits the maximum standardization of parts while allowing easy modification to fit all the different mountings of the various manufacturers of backboards.

The structure of the invention thus provides a more rigid, more easily adjustable structure with a longer useful life and one that can be produced at a lower cost.

DESCRIPTION OF THE PREFERRED EMBODIMENT OF THE INVENTION

Figures 1, 2:
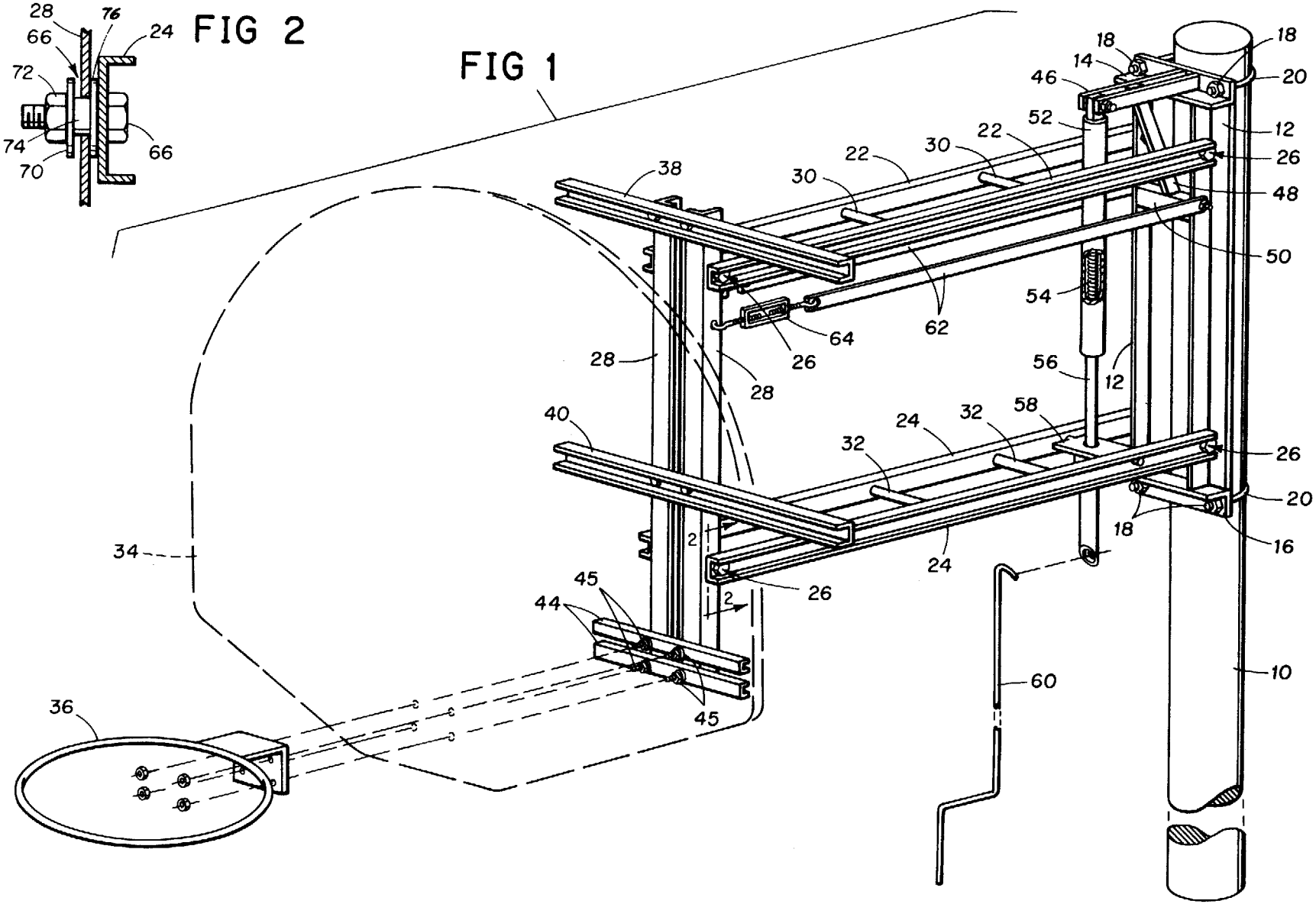
FIG. 1 is a perspective view, partly exploded, of a basketball goal mounting structure incorporating the principles of the invention, this figure showing a standard backboard in dotted lines.
FIG. 2 is an enlarged view partly in section and taken on the line 2—2 of FIG. 1 to show the unique fastening means for the pivotal joints of the structure.

Referring to the drawings which show a preferred embodiment of the invention, the adjustable basketball goal is mounted on a vertical support such as pole 10 which may be permanently installed in the ground or may be mounted upon a mobile platform (not shown) which will permit the goal to be moved from place to place. Of course, the goal could also be affixed to a wall or other fixed structure in a gymnasium.

In any event, the rear supporting structure consists of a pair of vertical supports 12 welded or otherwise joined to an upper horizontal member 14 and a lower horizontal member 16. Preferably, the supports 12 and members 14 and 16 are formed from heavy angle iron. The horizontal members 14 and 16 are preferably provided with holes through which extend fasteners 18 to secure the entire structure to the pole 10 by the use of U bolts 20.

Extending outwardly from the vertical supports 12 are a pair of parallel upper arms 22 and a pair of parallel lower arms 24. The upper arms 22 and lower arms 24 are pivotally connected to the vertical supports 12 by means of fasteners indicated generally by the reference numeral 26 and described more fully hereinafter. Fasteners 26 permit free pivotal movement of the upper and lower arms 22 and 24 with respect to the vertical supports 12.

At the outer ends of the upper arms 22 and lower arms 24 are pivotally connected the front vertical supports 28 which supports 28 are parallel to each other and also are parallel to the rear vertical supports 12. The front vertical supports 28 are pivotally connected to the outer ends of the upper arms 22 and lower arms 24 by fasteners 26 which permit free pivotal movement. Thus, the rear vertical supports 12, the upper arms 22, the lower arms 24 and the front vertical supports 28 form a parallelogram structure.

To add further strength and rigidity to the parallelogram structure, intermediate supports 30 may be provided between the upper arms 22 and similar intermediate supports 32 may be provided between the lower arms 24. Also, upper and lower arms 22 and 24 are preferably formed from small channel iron while the front vertical supports 28 are preferably formed from heavy angle iron.

To provide for the mounting of the backboard 34 and the associated goal 36, the front vertical supports 28 are provided with an upper cross-support 38 and a lower cross-support 40. These supports are positioned so as to fit the mounting openings on the backboard 34 and goal 36. In addition, I prefer to provide a pair of goal mounting members 44 at the lower end of the front vertical supports 28. These are positioned and are provided with openings to receive bolts 45 so as to match the mounting openings in the backboard 34 where the goal 36 is normally mounted. By providing longer bolts 45 or other fastening means, this permits the goal 36 to be secured also to the front vertical supports 28 rather than just to the backboard 34 itself. This provides a much stronger unit and minimizes the possibility of the goal 36 being broken off by a player hanging on the rim.

Also, by merely changing the length of the intermediate supports 30 and 32, and the horizontal spacing between the vertical supports 12 before they are joined to the members 14 and 16, the structure can be easily and inexpensively adapted to accommodate any manufacturer's goal 36. As is well known to those in the industry, the spacing of the mounting openings for the goals 36 varys from manufacturer to manufacturer. This ability to use any goal 36, provides for maximum standardization of the components of the structure thereby keeping the cost to a minimum.

In order to provide adjustability of the height of the goal 36, there is affixed to the upper rear horizontal member 14 an outwardly extending arm 46 which arm 46 is further supported by an angular support 48 that is fixed to a cross-member 50 welded between the two rear vertical supports 12. Support 48 is critical since arm 46 supports the entire structure and is the point of maximum stress, support 48 therefore practically eliminates failures at this point. At the outer end of arm 46 there is pivotally connected one end of a cylinder 52 into the upper end of which there is threaded a threaded member 54 the lower end of which member is threaded into rod 56. Rod 56 in turn extends through and is freely turnable in cross-member 58 which is pivotally mounted at its ends to the lower arms 24. The details of such an adjusting mechanism are known to those skilled in the art and are shown in U.S. Pat. No. 3,765,676. This arrangement permits the lower rod 56 to be turned by a removable crank 60 thereby raising or lowering the parallelogram structure and thereby raising and lowering the height of the goal 36. The arm 46 provides an improved mechanical advantage over prior art structures and makes it much easier to raise and lower the goal.

Since the structure will be subject to wear at the pivotal connections, I have made two provisions to compensate for this wear. First, I have provided a chain, cable or steel strap 62 which is connected at one end to each of the rear vertical supports 12 and is connected at its other end to a turnbuckle 64 that in turn is connected to the front vertical supports 28. Turnbuckle 64 is used to facilitate tightening as the structure wears through normal use. A spring or other resilient means could also be used either alone or with turnbuckle 64. This will keep the parallelogram structure tight by keeping pressure on all the joints and compensate for wear as the pivotal connections wear. It will also permit lower manufacturing tolerances while still providing a rigid structure that will not excessively vibrate during use when struck by the ball or by a player.

In addition, the unique fastening members at each of the pivotal connections between the parallelogram structure are shown in FIG. 2. These fasteners consist of a hex head bolt 66, a spacer 68, a washer 70 and a nut 72. The spacer 68 is a one-piece structure having an annular bearing or sleeve 74 and an enlarged washer-like head 76. The annular bearing 74 provides a bearing surface upon which the structure pivots. The width of the spacer 68 is slightly larger than the thickness of the vertical support 12 or 28 to which it is connected thereby allowing free pivotal movement at the same time providing for tightening of the nut 72 upon the bolt 66. This provides a larger bearing surface than if bolts without spacers were used. It also facilitates the manufacture and assembly of the unit and eliminates the scraping of the decorative paint on the unit as the parallelogram structure pivots. When the unit is used in an outdoor application, this minimizes the possibility of rust formation as the joints as the paint is scraped off during normal use of the unit. As noted above, the fasteners 26 are used at each of the pivotal connections in the parallelogram structure.

A unit constructed according to the above-described preferred embodiment will be a strong, rigid unit that is however easily adjustable upwardly and downwardly to vary the height of the goal between 6 and 10 feet. The unit uses standardized components which makes the unit easy to manufacture and assemble. Also, the unique fastener arrangement at the pivotal connections improves the useful life of the unit by providing a larger bearing surface and avoiding corrosion at the joints due to scraping off of the paint as the unit pivots.

Having thus described my invention, it will be obvious to those skilled in the art that various revisions and modifications can be made to the preferred embodiment disclosed herein without departing from the spirit and scope of the invention. It is my intention however that all such revisions and modifications shall be included within the scope of the following claims.

I claim:

1. An adjustable support for basketball backboards and goals and the like, said support comprising a rear vertical support, a front vertical support spaced forwardly from the rear vertical support, upper and lower horizontal supports pivotally connected to the front and rear supports so as to form a parallelogram arrangement, tightening means extending between the rear vertical support and the front vertical support to maintain the rigidity of the structure as its pivotal connections wear through normal use, a main support arm fixed to the rear vertical support and extending forwardly therefrom, adjustable means having its upper end pivotally connected to the outer end of the main support arm and having its lower portion pivotally connected to the lower horizontal supports so as to provide for raising and lowering of the front vertical supports, backboard mounting means affixed to the front vertical support, and goal mounting means on the lower end of the front vertical support providing for direct fastening to said support of the goal and the backboard.

2. The adjustable support of claim 1 in which each of the pivotal connections between the front and rear vertical supports and the upper and lower horizontal supports comprises a removable fastener extending through each of the members to be pivotally connected and a spacer providing a bearing surface for said pivotal movement while also providing for tightening of the fastener without binding the support members to be connected.

* * * * *